United States Patent [19]

Dunchock

[11] 4,204,602

[45] * May 27, 1980

[54] EYEGLASS CASE DISPLAY UNIT

[75] Inventor: Richard S. Dunchock, Farmington Hills, Mich.

[73] Assignee: Optarac Corporation, Southfield, Mich.

[ * ] Notice: The portion of the term of this patent subsequent to Dec. 9, 1992, has been disclaimed.

[21] Appl. No.: 893,316

[22] Filed: Apr. 3, 1978

Related U.S. Application Data

[63] Continuation-in-part of Ser. No. 655,747, Feb. 6, 1976, Pat. No. 4,084,700.

[51] Int. Cl.[2] ..... A47R 7/02

[52] U.S. Cl. ..... 211/13; 248/126; 248/DIG. 2

[58] Field of Search ..... 211/13, 87; 248/DIG. 2, 248/121, 124, 126, 220.3, 220.4, 224.4, 225.2; 206/5; D16/82

[56] References Cited

U.S. PATENT DOCUMENTS

| | | | |
|---|---|---|---|
| D. 161,151 | 12/1950 | Ackerman et al. | 248/DIG. 2 X |
| 1,060,581 | 5/1913 | Buegeleisen | 211/13 |
| 1,247,033 | 11/1917 | Swartz | 248/459 |
| 1,686,002 | 10/1928 | Herzon | 248/DIG. 2 X |
| 2,551,539 | 5/1951 | Horton | 248/220.3 X |
| 2,713,947 | 7/1955 | Foster | 211/13 |
| 2,735,597 | 2/1956 | Treleven | 248/DIG. 2 X |
| 3,014,597 | 12/1961 | McWherter | 248/220.4 X |
| 3,195,731 | 7/1965 | Bomar | 211/13 |
| 3,229,944 | 1/1966 | Everburg | 248/220.3 |
| 3,306,564 | 2/1967 | Nickel | 248/220.3 |
| 3,351,208 | 11/1967 | Siegel | 211/13 |
| 3,473,671 | 10/1969 | Gangitano | 211/57.1 X |
| 3,817,392 | 6/1974 | Bloch | 211/13 |
| 3,924,750 | 12/1975 | Dunchock | 211/13 |
| 4,084,700 | 4/1978 | Dunchock | 211/41 |

FOREIGN PATENT DOCUMENTS

| | | | |
|---|---|---|---|
| 111208 | 7/1944 | Sweden | 248/124 |
| 448022 | 3/1935 | United Kingdom | 248/DIG. 2 |

*Primary Examiner*—Thomas J. Holko
*Attorney, Agent, or Firm*—Basile and Weintraub

[57] ABSTRACT

A display rack for mounting eyeglass cases and like articles wherein the display rack has a body panel with integrally formed top and base flanges which, respectively, are adapted to releasably attach the body panel to an upright wall or support the body panel in an upright position on a horizontal surface. In the present invention the body panel is provided with a plurality of pairs of laterally spaced slots disposed at selected vertical locations. Each pair of laterally spaced slots is adapted to releasably support a display holder which, in turn, supports an eyeglass case such that a plurality of eyeglass cases may be mounted on the front of the body panel for ease of display.

3 Claims, 5 Drawing Figures

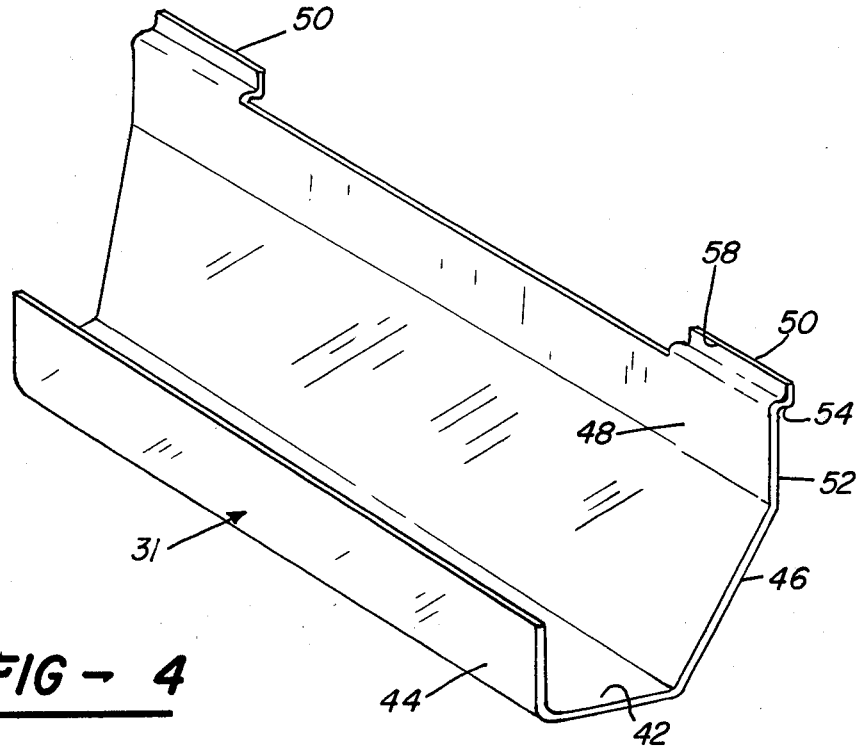
FIG – 4
FIG – 5
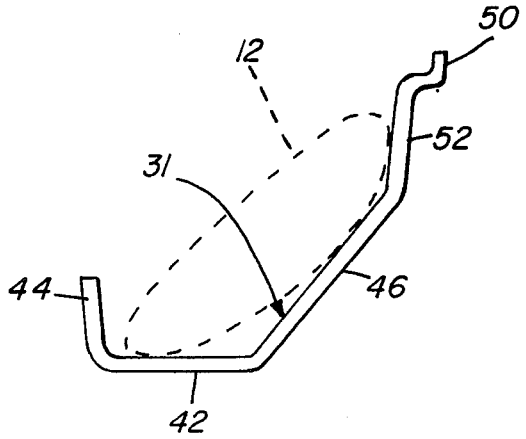

EYEGLASS CASE DISPLAY UNIT

CROSS REFERENCE TO RELATED APPLICATIONS

The present invention is a continuation-in-part of co-pending U.S. patent application Ser. No. 655,747 filed Feb. 6, 1976, and now U.S. Pat. No. 4,084,700 issued Apr. 18, 1978, and is related in substance to U.S. patent application Ser. No. 501,178 filed Aug. 28, 1974, and now U.S. Pat. No. 3,924,750. U.S. patent application Ser. No. 655,747 is incorporated herein by reference.

BACKGROUND OF THE INVENTION

I. Field of the Invention

The present invention relates to a new and useful improvement in display stands, racks and units and, more particularly, to a display rack which may be selectively mounted to a vertical wall or disposed in an upright position on a horizontal surface for the purpose of displaying articles of manufacture and, in particular, for displaying eyeglass cases.

II. Description of the Prior Art

Heretofore numerous devices and apparatuses have been employed to display various elements including the displays associated with the sale of eyeglasses and related articles. Examples of such displays are disclosed in U.S. Pat. Nos. 3,333,708; No. 3,351,208; No. 3,473,671; No. 1,803,016; No. 1,716,863; No. 1,529,347; No. 2,642,190; No. 2,764,286; No. 3,089,269; No. 3,352,425; and No. 2,949,683; French Pat. No. 1,421,487; Swiss Pat. No. 131,557; Swedish Pat. No. 111,208; West German Pat. No. 670,172; and Great Britain Pat. No. 10079. These patents are relevant in that they were cited during the prosecution of U.S. Pat. No. 3,924,750. Additional patents which are relevant to applicant's invention were cited in co-pending U.S. patent application Ser. No. 655,747 and are as follows: U.S. Pat. No. 1,247,033; No. 1,842,118; No. 3,858,726; No. 759,040; No. 3,351,208; No. 3,431,667; No. 2,926,607; No. 3,608,220; No. 993,674; No. 3,184,058; and No. 1,665,271; British Pat. No. 669,604; and German Pat. No. 31014.

While the display racks disclosed in the aforementioned United States and foreign patents have provided various means associated with the display of eyeglasses and related paraphernalia, none of the display racks provide a simple, attractive and inexpensive unit which may be used to display eyeglass cases and other articles as desired wherein the display unit may be selectively mounted to a vertical wall or disposed in an upright position on a horizontal support.

III. Prior Art Statement

The above-mentioned patents, in the opinion of applicant and applicant's attorneys, constitute the most relevant prior art of which they are aware.

SUMMARY OF THE INVENTION

The present invention, which will be described subsequently in greater detail, comprises a display rack having a body panel on which are mounted means for carrying a plurality of articles of manufacture and, in particular, for mounting a plurality of eyeglass cases. The display rack has means providing for the removable attachment of a plurality of holders which support the eyeglass cases for display. The body panel of the display rack is provided with means which selectively permit the simple mounting of the display rack on a vertical wall or which permit the rack to be supported in an upright position on a horizontal surface.

It is therefore an object of the present invention to provide a new and improved display rack for the mounting and display of articles of manufacture.

It is a further object of the present invention to provide a display rack for the mounting of eyeglass cases wherein the eyeglass cases are safely carried by the display rack but may be simply removed and replaced, as desired.

It is still an object of the present invention to provide a display rack for the mounting of a removably attachable holder which is adapted to support a plurality of articles of manufacture displayed for sale.

It is still a further object of the present invention to provide a display rack having all the afore-mentioned advantages, yet one which is extremely simple in its design and configuration and, thus, economical to manufacture and ultimately one which is highly marketable within its selected field.

Other objects, advantages and applications of the present invention will become apparent to those skilled in the art of display racks and the like when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and in which:

FIG. 4 is an enlarged, perspective view of the eyeglass case holder illustrated on the display rack shown in FIG. 1; and FIG. 5 is a side elevational view of the eyeglass case holder illustrated in FIG. 4.

DESCRIPTION OF THE PREFERRED EMBODIMENT

Figure 2:
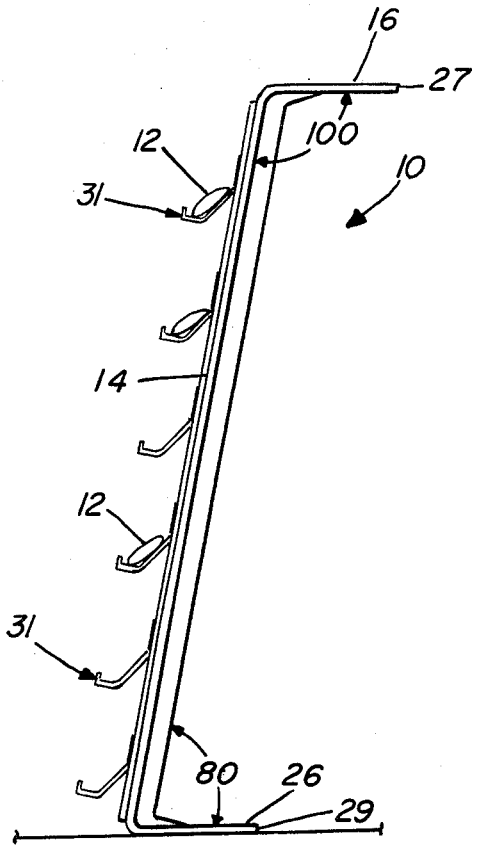
FIG. 2 is a side elevational view of the display rack illustrated in FIG. 1 with the display rack being illustrated in an upright position and supported on a horizontal surface.
Figure 1:
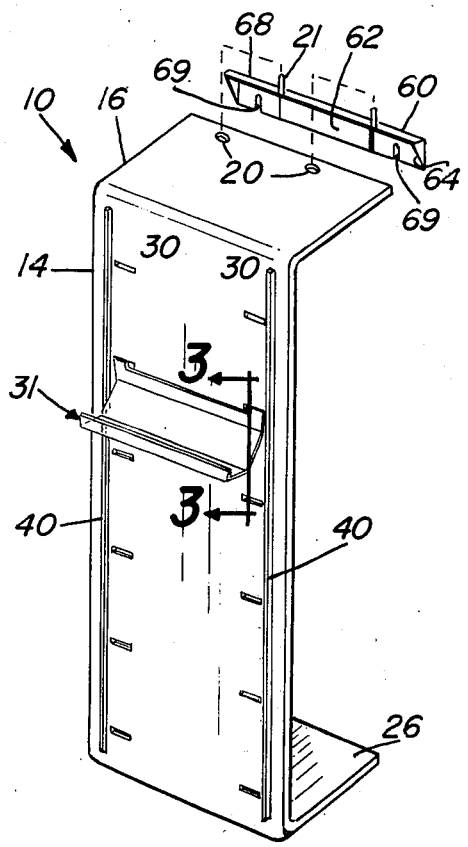
FIG. 1 is a perspective view of an eyeglass case display rack illustrated in an upright position for support on a vertical surface with all but one of the eyeglass case holders being removed for clarity.
Figure 3:
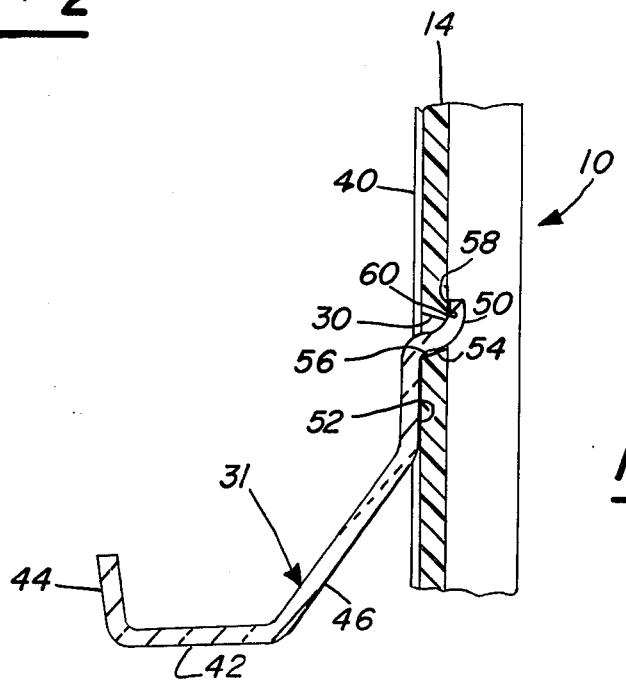
FIG. 3 is a fragmentary, enlarged sectional view of the display rack taken along line 3—3 of FIG. 1.

Referring now to the drawings and, in particular, to FIGS. 1 through 3 wherein there is illustrated one example of the present invention in the form of a display rack 10 which is utilized to support a plurality of eyeglass cases 12 (FIG. 2) to facilitate the marketing of the eyeglass cases 12. It should be understood that the term "eyeglass cases" refers to any of the numerous types of commercially available cases which are used as protective covers for eyeglasses.

The display rack 10 comprises a rectangularly shaped front or body panel 14 having an integrally formed top flange 16 that is disposed in a plane that is inclined approximately 100 degrees (FIG. 2) with respect to the plane of the front body panel 14. The extending end portion of the top flange 16 has a pair of laterally spaced hanging apertures 20 through which suitable attaching prongs 21, as will be described hereinafter, extend for the purpose of facilitating the removable mounting of the display unit 10 to a vertical wall in a manner which will also be described in greater detail hereinafter.

The lower portion of the body panel 14 has a rearwardly projecting, integrally formed base flange 26. The base flange 26 is parallel to the top flange 16 and is also inclined with respect to the plane within which the body panel 14 is disposed such that the angle of inclination (FIG. 2) between the body panel 14 and the base flange 26 is preferably 80 degrees. The distance from the outer face of the body panel 14 to the rearwardly facing edge 27 of the top flange 16 is equal to the distance from the outer face of the body panel 14 to the rearwardly facing outer edge 29 of the base flange 26. Thus, when the display unit 10 is mounted to a vertical wall such as when the support prongs 21 extend through the apertures 20, as will be described hereinafter, the rearwardly facing edges 29 and 27, respectively, of the base flange 26 and the top flange 16 will both rest against the vertical wall. Since the rearwardly facing edges of the top flange 16 and the base flange 26 are of an equal distance from the outer face of the body panel 14, the rectangularly shaped body panel 14 is disposed in a substantially vertical plane.

It is intended that the display rack 10 be mounted to a vertical wall and a potential customer, upon viewing the eyeglass cases carried on the display rack 10, may remove such display rack 10 and mount the same on a table or other horizontal surface simply by resting the display rack 10 on its base flange 26, as illustrated in FIG. 2, whereupon individual cases may be simply and easily removed from the display unit 10 for close inspection by the customer.

To this end, the display unit 10 is provided with a pair of L-shaped supports 60 (only one of which is shown in FIG. 1), each of which has an intermediate portion 62, which in conjunction with the base section 64 of the support 60 defines a slot thereinbetween. The slot snugly receives the outer side edges of the base flange 26, as more specifically disclosed in co-pending patent application Ser. No. 655,747, now U.S. Pat. No. 4,084,700 while the opposite ends of each support 60 extend forwardly and rearwardly of the base flange 26 to aid in supporting the display unit 10 in an upright position. The supports 60 are used when it is desired to maintain the display rack 10 in the upright position for long periods of time as opposed to its removal from a vertical wall surface for temporary positioning in an upright position. It should be noted that the other leg 68 mounts the two projecting prongs 21 (FIG. 1), while the base section leg 64 is provided with a pair of laterally spaced slots 69, the purpose of which will be described hereinafter.

As can best be seen in FIG. 1, the rectangularly shaped body panel 14 is provided with a series of vertically spaced and horizontally opposed pairs of support slots 30, each pair of support slots 30 being adapted to releasably support an eyeglass case holder 31 in the manner illustrated in FIGS. 1, 2 and 3. While only one pair of support slots 30 and one holder 31 will be described in detail, it should be understood that the description herein refers equally to all of the support slots 30 and all of the holders 31 carried by the display rack 10.

Each support slot 30 in a laterally elongated opening on the outside surface of the body panel 14 in a rectangular shape. The slots 30 each are tapered inwardly and open to the rear surface of the body panel 14 in a smaller sized rectangular shape. Each set of support slots 30 is laterally spaced from each other and so sized as to receive and support one eyeglass case holder 31 in a manner which will insure the safe and secure mounting of the holder 31 to the support slots 30 and thus to the face of the body panel 14. This arrangement of two support slots 30 for the mounting of a single eyeglass case holer 31 lends itself favorably to the simple and secure display of eyeglass cases 12 to the face of the body panel 14 and permits the display rack 10 to be positioned on a vertical wall in the manner aforementioned and removed therefrom and positioned on a horizontal surface without concern for the eyeglass cases 12 falling from their supporting case holder 31.

As can be seen in FIGS. 1, 2 and 3, a pair of laterally spaced and vertically disposed ribs 40 are provided on opposite sides of the front face of the body panel 14. The ribs 40 are integral projections on the front surface of the body panel 14 and provide a decorative feature to enhance the appearance of the display rack 10.

Referring now to FIGS. 4 and 5 wherein there is illustrated an enlarged view of the eyeglass case holder 31. The case holder 31 comprises a one-piece molded article, preferably fabricated from a clear or transparent plastic material. Each case holder 31 comprises a base section 42 having an upright wall member 44. The wall member 44 extends upwardly a sufficient distance to insure that the case 12 remains securely within the confines of the case holder 31, yet low enough so as not to interfere with the customer's view of the eyeglass case 12. The base section has a rearwardly inclined wall 46 which, in turn, includes an upright section 48. The section 48 has laterally spaced, doubled, right-angled tabs 50 that define a shoulder 54. The tabs 50 are spaced apart a distance equal to the distance between the slots 30 and are received therein in the manner shown in FIG. 3. In the position illustrated in FIG. 3, the inside surface 52 of the upright section 48 abuts the body panel 14, while the inside shoulder 54 of the tab 50 rests on the slot wall 56. At the same the outside surface 58 of the tab 50 abuts the rearward side 61 of the body panel 14. In this position the case holder 31 is secured to the body panel 14. Removal of the case holder 31 can be simply had by rotating the same clockwise, as viewed in FIG. 3, to disengage the tabs 50 from the slots 30.

It can thus be seen that the present invention provides a new and improved display rack for eyeglass cases which is extremely simple in construction and which may be easily and simply mounted to a vertical wall or placed in an upright position on a horizontal support.

While only one form of the present invention has been disclosed, it should be apparent to those skilled in the art of display racks that other forms of applicant's invention may be had, all coming within the spirit of the invention and scope of the appended claims.

What is claimed is as follows:

1. A display rack for article of manufacture and the like, said display rack comprising:

a body panel having a plurality of laterally spaced apertures disposed in a vertical arrangement on the outside face of said body panel;

a plurality of article holder members, each of said members having a bottom wall and integrally disposed upright front and rear walls, the front wall being of sufficient size to retain an article on said base surface, the rearward wall extending upwardly and being provided with a pair of laterally spaced tab members adapted to be releasably secured to said body panel by means of engagement with said laterally spaced apertures;

means associated with said body panel for maintaining said body panel in an upright position;

a top flange extending behind said body panel for mounting said body panel to a vertical wall;

a base flange for supporting said body panel in an upright position; and wherein said top flange and said base flange are integral rearward projections of said body panel, said base flange being disposed in a plane which is inclined with respect to the plane within said body panel is disposed, the perpendicular distance from the face of said body panel to the outer edge of said top flange being equal to the perpendicular distance from said body panel face to the outer edge of said base flange, whereby said body panel is disposed in a vertical plane when said top flange is attached to a vertical wall and said top flange and base portion outer edges abut against said vertical wall.

2. The display rack defined in claim 1 wherein said article is an eyeglass case, said holder being sized to securely mount said eyeglass case therein.

3. The display rack defined in claim 1 wherein said article is an eyeglass case, said holder being pivotally secured to said aperture such that said holder is swingable away from said body wall when said body wall is moved so as to minimize the possibility of said eyeglass cases falling from said holder, said holder being sized so as to securely retain said eyeglass cases thereinbetween said front and rear walls of said holder.

* * * * *